United States Patent [19]

Riede

[11] 3,963,888

[45] June 15, 1976

[54] MULTI-ANGLE TILT SWITCH DEVICE WITH ADJUSTABLE OSCILLATING CONTROLLER

[75] Inventor: John R. Riede, White Bear Lake, Minn.

[73] Assignee: Riede Systems, Inc., Minneapolis, Minn.

[22] Filed: Feb. 28, 1975

[21] Appl. No.: 554,315

[52] U.S. Cl. ..... 200/61.48; 200/61.52

[51] Int. Cl.[2] ..... H01H 35/14

[58] Field of Search ..... 200/61.45 R, 61.48, 200/61.5, 61.51, 61.52, 61.53, 84 R

[56] References Cited

UNITED STATES PATENTS

| | | | |
|---|---|---|---|
| 2,043,530 | 6/1936 | Dezotell | 200/84 R |
| 2,235,328 | 3/1941 | Neeper | 200/61.48 X |
| 2,596,427 | 5/1952 | Nordmark et al. | 200/61.51 |
| 2,596,666 | 5/1952 | Edgar et al. | 200/84 R |
| 2,768,256 | 10/1956 | Barecki et al. | 200/61.48 |
| 3,066,202 | 11/1962 | Kaleba et al. | 200/61.52 X |
| 3,175,059 | 3/1965 | Chesnut | 200/61.52 |
| 3,790,727 | 2/1974 | Laserson et al. | 200/61.51 X |
| 3,898,400 | 8/1975 | Takada | 200/61.52 X |

*Primary Examiner*—James R. Scott
*Attorney, Agent, or Firm*—Stuart R. Peterson

[57] ABSTRACT

The tilt switch device includes a cylindrical casing having a platform therein located near its upper end. A circular disc has a downwardly projecting flange or skirt which rests on the platform. A rod is threadedly attached to the center of the disc, the upper end of the rod projecting a preferred distance thereabove. The rod depends downwardly from the disc through a hole in the platform. Carried at the lower end of the rod in a pendulum-like manner is a tubular weight member which is immersed in a damping fluid contained in the casing. Whenever there is a sufficient relative angular displacement of the casing with respect to the rod, the disc fulcrums or pivots about a segmental portion of its peripheral edge to cause the upper end of the rod to rock upwardly. A snap action switch unit, which is fixedly mounted in the upper end portion of the casing, has a downwardly biased plunger, the upward shifting or rocking of the end of the rod forcing the plunger upwardly to close a pair of normally open switch contacts (or to open a pair of normally closed contacts).

2 Claims, 3 Drawing Figures

MULTI-ANGLE TILT SWITCH DEVICE WITH ADJUSTABLE OSCILLATING CONTROLLER

BACKGROUND OF THE INVENTION

1. Field of the Invention

This invention relates generally to electric switches, and pertains more particularly to a tilt switch device.

2. Description of the Prior Art

Various tilt switches have been devised and have proven generally satisfactory for their intended purposes. Most of the designs with which I am acquainted utilize one or more mercury switches. Where a high speed of response is desired, the mercury switch has performed quite well. However, when momentary displacements of an inconsequential nature are experienced, the high rate of responsiveness, where mercury switches are employed, proves to be a disadvantage. To provide a time delay in such situations, a time delay relay is employed. Such a relay, while ignoring any brief bridging of the contacts by the mercury pool, adds another cost to the many systems using such a tilt switch.

SUMMARY OF THE INVENTION

Accordingly, one object of my invention is to provide a highly versatile tilt switch device which is simple, rugged and which can be manufactured quite inexpensively.

Another object is to provide a tilt switch device that will operate in any angularly direction with respect to a vertical axis. More specifically, an aim of the invention is to provide a tilt switch device that is inactive or passive when in a vertical or zero degree tilt position, yet when shifted from the vertical in any radial direction throughout an entire 360° circle will denote a tilted condition.

Another object of my invention is to provide a multi-angular tilt switch device of the foregoing character which will have a predetermined initial dead-band angle during which the switch contacts remain in their normally closed or normally open position, as the case may be, but which are operated immediately after the dead-band angle has been exceeded. Stated somewhat differently, an aim of the invention is to avoid momentary contact making or breaking where the significance of the momentary displacement is of no real consequence.

Still further, an object of the invention is to provide a tilt switch device having a dead-band angle that can be changed, that is either increased or decreased, to suit the particular circumstances encountered in a given installation. In this regard, it is within the purview of my invention to substitute either or both of two parts for the other in achieving the proper dead banding, or to make a simple rod adjustment so as to provide more or less pretravel between the rod and the plunger of the snap action switch unit.

Yet another object of my invention is to provide a tilt switch device that will always return to an "off" or unoperated position even though the device may not resume a truly vertical position after having been tilted, this sometimes occurring due to friction because of the way the tilt switch is hung. In a mercury type tilt switch, such lack of vertical return can result in a failure to operate as intended.

It is also within the contemplation of my invention to delay the operation of my device when tilted as well as its return to a vertical or nontilted position by means of a damping fluid contained in the device itself.

Still further, an object is to provide a tilt switch device that is responsive to a predetermined angular displacement of a pendulum-like rod and weight member from a vertical position with respect to the surrounding casing, or an angular displacement of the casing with respect to the rod and weight member, or a combination of both.

Briefly, my invention envisages the mounting of a snap action switch unit containing therein at least one pair of cooperable electrical contacts, the plunger of the switch unit extending downwardly into adjacency with the end of a rod projecting upwardly from a circular disc member. By reason of the rod being threadedly attached to the disc, the distance it projects above the disc can be varied to change the amount of pretravel before the plunger is actuated sufficiently to operate the switch unit. The peripheral edge of the disc member, actually the lower edge of a cylindrical flange or skirt, is supported on a platform having a hole centrally disposed therein. The rod, the upper end of which engages the plunger of the switch unit, depends downwardly from the central portion of the disc to which it is threadedly attached, carrying thereon a weight member at its lower end, thereby producing a pendulum-like action whenever there is a relative angular displacement between the rod and the casing in which the platform is fixedly disposed.

Inasmuch as the peripheral edge of the disc rests on the platform, it follows that an angular displacement or tilt in any direction from a vertical axis will cause a segmental edge portion of the disc to fulcrum or pivot on the platform so that the centrally disposed upper end of the rod will move upwardly against the plunger of the snap action switch unit to actuate the electrical contacts contained therein. There must be a sufficient angular tilt before the snap action unit will be operated, this being due to whatever distance exists between the center of the disc and its peripheral edge; in other words, the radius of the disc provides an initial dead-band angle in which the switch unit is not operated. Also, the radial distance causes the pendulum-like unit composed of the rod and weight member carried thereby to return to a true vertical position without any residual displacement. Still further, the weight member can be immersed in a suitably viscous fluid so as to retard or delay its movement and consequently that of the rod and the disc from which it is suspended. Even though a multi-angular response is derived, only one switch unit is needed in order to indicate the tilt or a relative angular displacement in any direction throughout a 360° range with respect to the vertical.

DESCRIPTION OF THE PREFERRED EMBODIMENT

Figure 2:
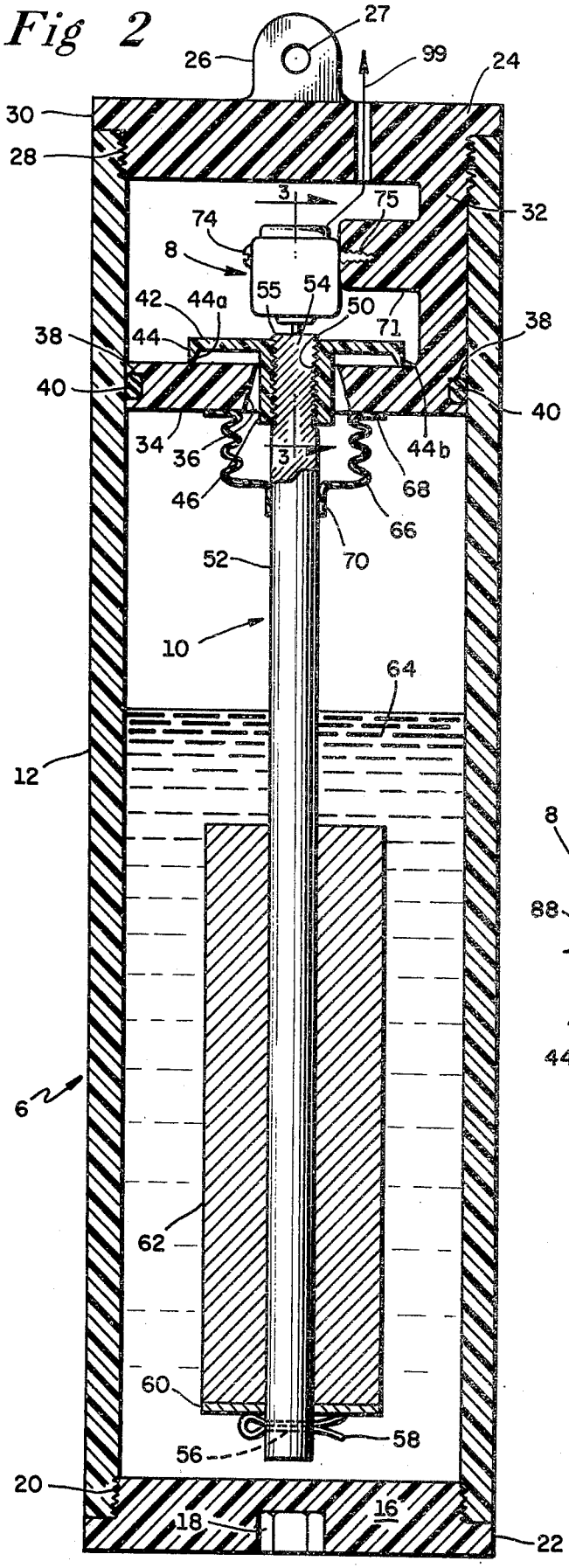
FIG. 2 is a sectional view taken in the direction of line 2—2 of FIG. 1.

Referring now in detail to the drawing, my tilt switch device has been denoted generally by the reference numeral 6. Included in the device 6 is a snap action switch unit 8 and an actuating mechanism 10 for operating the switch unit 8. Inasmuch as the switch unit 8 is of conventional construction, it need not be described in any great detail; however, a sufficient amount of description will hereinafter be given so as to enable the reader to understand generally what occurs.

Before describing the actuating mechanism 10, it will be explained that the device 6 also includes a cylindrical casing 12, either of metal or impact-resistant plastic. The lower end of the cylindrical casing 12, in the illustrative situation, is closed by a bottom closure member 16 having a wrench socket 18 so that the member can be advanced upwardly by means of threads 20 to cause its flange 22 to abut against the lower end of the cylindrical casing 12. Although not shown, a suitable gasket can be placed between the flange 22 and the lower edge of the casing 12. While preferably removable, in some cases the closure member 16 may be integral with the casing 12 or sealed permanently in place inasmuch as access to the interior of the casing may be had via the upper end, as will now be described.

Accordingly, an upper closure member 24, which, as illustrated, has an upstanding ear or lug 26 formed with an eye or opening 27 therein, can be advanced downwardly by means of threads 28 to cause its flange 30 to abut against the upper end of the casing 12. In this instance, the ear or lug 26 provides an adequate means for effecting the twisting action, it only being necessary that a jaw-type wrench be applied to the sides of the ear or lug 26 in contradistinction to a socket wrench for the bottom closure member 16.

It is convenient, at least for purposes of illustration, to show a downward wall or panel 32 integral with the closure member 24. The wall or panel 32 serves as a ready means for holding in place a platform 34 having a beveled central hole or aperture 36, the aperture 36 flaring outwardly from the top of the platform 34 downwardly to the bottom surface thereof. Although the reason therefore will become manifest as the description progresses, there is an annular groove 38 formed around the platform 34 which accommodates therein an O-ring 40 of resilient material, such as neoprene.

The platform 34 is really part of the actuating mechanism 10, functioning as a support for a disc 42 playing an important role in the practicing of my invention. As with the casing 12, its end closures 16, 24 (and also the platform 34), the disc 42 can be formed of a suitable metal or a synthetic plastic. The disc 42 has a peripheral flange or skirt 44 projecting downwardly. More specifically, the lower edge of the flange or skirt 44 has what might be termed a rounded or semicircular "knife" edge which rests on the upper surface of the platform 34. Projecting downwardly from the central portion of the disc 42 and integral therewith is a tubular boss 46 providing a passage extending completely through both the disc 42 and boss 46, the passage having internal threads 50. The outer diameter of the tubular boss 46 is related with respect to the size of the aperture or hole 36 such that a maximum angular or rocking of the disc 42 can occur without the boss 46 striking the edge of the platform 34 circumjacent the boss 46.

Further included in the actuating mechanism 10 is a rod 52, having a threaded upper end portion 54 engaged in the tubular boss 46 to provide a slightly raised end 55, the distance the end 55 projects above the disc 42 being adjustably determined by reason of the threaded connection of the end portion 54 with the boss 46. The rod 52 extends downwardly to a point near the bottom end closure 16. The lower end portion of the rod 52 is transversely drilled to form a passage at 56 for the accommodation therein of a cotter pin 58. The cotter pin 58 serves as a retainer for a washer 60 on which is carried a tubular weight member 62. By removing the cotter pin 58, one weight member 62 can be substituted for another. The resulting change in diameter, length, shape and specific gravity of the material from which the weight member is fabricated can be changed to affect or influence the sensitivity of response, as will soon become manifest.

It will also be understood that the swinging or rate of angular movement of the weight member 62 can be influenced or controlled by suitable damping fluid 64 contained in the lower portion of the casing 12. Preferably, a liquid is selected having a flat viscosity curve with respect to temperature, a silicone fluid having been found generally satisfactory. The fluid 64 is of especial advantage in retarding or delaying the action of the rod 52, or the casing 12 (as the case may be), to its vertical position after deflection has occurred.

Inasmuch as it is planned that the fluid 64 be placed in the casing 12 at the factory, a precautionary measure is taken which assures that the fluid 64 will not pass through the beveled opening 36 in the platform 34, which it might very well do if the device 6 is placed on its side during shipment. Therefore, a thin rubber bellows 66 is provided with a flat annular end 68 which is adhered to the underside of the platform 34 around the beveled opening 36. The bellows 66 is also provided with a cylindrical end 70 that is in turn adhered to the rod 52. It will be understood that the bellows 66 is sufficiently flexible so that it does not interfere with the pendulum-like swinging of the rod 52 and weight member 62.

The snap action switch unit 8 has already been generally mentioned, and even though it is of conventional construction, a brief description thereof should help in appreciating the benefits to be derived from a practicing of my invention. First, though, it should be noted that the downward section 32 which resides between the closure member 24 and the platform 34 has a horizontal rib 71 projecting laterally therefrom.

Referring now to the snap action switch unit 8, it will be seen that it comprises a plastic casing 72 having a pair of holes 73 (FIG. 3) which accommodate a pair of mounting screws 74 (FIG. 2) each having a threaded shank 75 which extends into the rib 71 to anchor the switch unit 8 in a fixed relation relative to the casing 12 (and of course relative to the platform 34).

Figure 3:
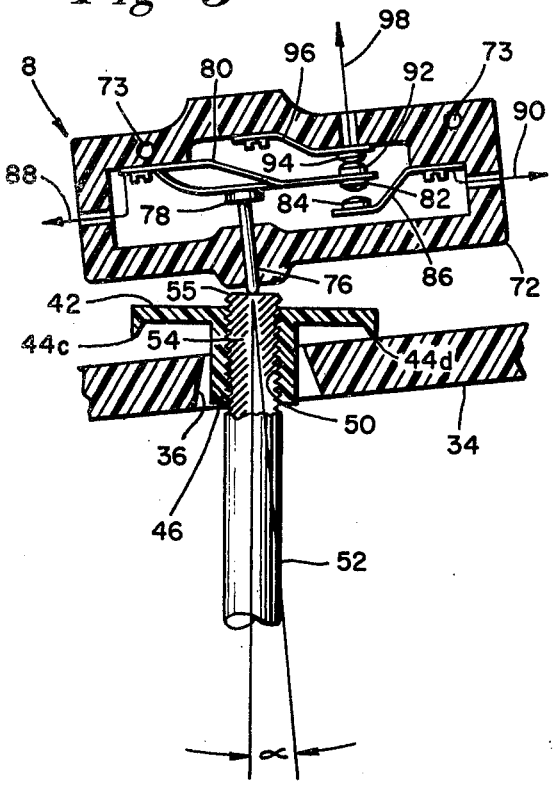
FIG. 3 is a sectional detail view taken in the direction of line 3—3 of FIG. 2 to show the manner in which the switch unit is actuated when the device is deflected into the dotted line position appearing in FIG. 1.

As can be discerned from FIG. 3, the casing 72 has a passage 76 extending through its bottom wall which passage accommodates a vertically reciprocal plunger 78. The upper end of the plunger 78 bears against (or can be connected to) a snap action resilient arm 80 having a contact 82 at its free end. The resilient arm 80 normally biases the plunger 78 downwardly. The contact 82, which is movable with the arm 80, is cooperable or engageable with a fixed contact 84 mounted on the free end of a fixed arm 86.

For the sake of completeness, a conductor 88 has been shown extending from the anchored end of the resilient arm 80. Similarly, a conductor 90 extends from the anchored end of the arm 86. It will be recognized that the contacts 82, 84 constitute a pair of normally closed contacts, the biasing action of the resilient arm 80 normally moving the contact 82 downwardly into engagement with the contact 84 (and also yieldingly pressing or biasing the plunger 78 downwardly). Hence, the conductors 88, 90 can be conned.ed to a circuit which indicates or otherwise denotes when the contacts 82, 84 are closed, this being a non-tilted condition of the device 6.

The resilient arm 80 also carries at its free end a movable contact 92 that is cooperable with a fixed contact 94 mounted on an arm 96, more specifically a strip, that is anchored to the plastic casing 72. A conductor 98 is connected to the arm 96. Thus, the contacts 92, 94 consititute a pair of normally open contacts which are closed (as in FIG. 3) when the plunger 78 is urged upwardly to flex the resilient spring arm 80 to move the contact 92 into engagement with the contact 94. The individual conductors 88, 90 and 98 in practice would be combined into a three-wire cable 99 (FIG. 2). An indicator or alarm circuit (not shown) which can be connected to the conductors 88, 98 (or to the conductors 88, 90) and the energization of such a circuit will denote when the contacts 92, 94 (or the contacts 82, 84) are closed.

Figure 1:
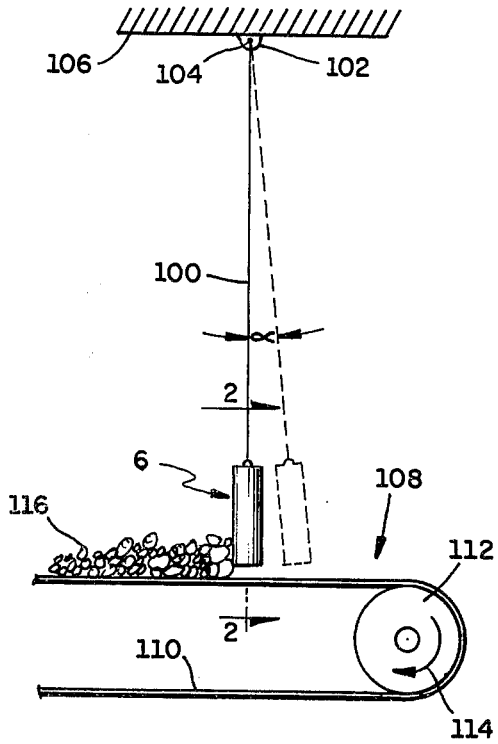
FIG. 1 is an elevational view showing one use of my invention.

While the versatility of my invention will render it useful in a number of environmental instances, FIG. 1 has been presented for the purpose of showing one particular application of the device 6. In FIG. 1, a chain, cable or wire 100 has been attached to the ear or lug 26, more specifically through its eye or opening 27. Although not illustrated in FIG. 1, the three-wire cable 99 (FIG. 2) composed of the conductors 88, 90 and 98 (FIG. 3) would extend along the flexible suspension element 100. The upper end of the suspension element 100 is attached to an ear or lug 102 having an eye or hold 104 therein, the ear or lug 102 being integral with a fixed surface, such as an overhead beam, labeled 106. A fragmentarily pictured conveyor 108 comprising an endless belt 110 passing about a roller or drum 112 which rotates in the direction of the arrow 114 carries thereon aggregate denoted by the reference numeral 116.

What happens in the exemplary situation appearing in FIG. 1 is that the aggregate 116 carried on the belt 110 moves against the device 6, deflecting it from its solid line position into its dotted line position. In other words, the device 6 is displaced from a true vertical position into an angularly displaced position which has been indicated by $\alpha$. As can be understood from FIG. 3, the displacement of the device 6 through the angle $\alpha$ causes one segment of the peripheral flange or skirt 44 to fulcrum or pivot on the platform 34.

More specifically, it will be noted that the diametrically spaced segmental portions of the flange or skirt 44 have been assigned the reference numerals **44*a* and 44*b* in FIG. 2, whereas the diametrically opposite segmental edge portions in FIG. 3 have been given the reference numerals 44*c* and 44*d*, the segments 44*c* and 44*d* being quadrantly located with respect to the portions 44*a* and 44*b*. Owing to the direction in which the view constituting FIG. 2 is taken in FIG. 1, plus the direction in which the view constituting FIG. 3 is taken in FIG. 2, FIG. 3 becomes representative of the deflected or dotted line position of the device 6 in FIG. 1.**

Thus, the segmental edge **44*d* is the peripheral portion that fulcrums or pivots on the platform 34 in FIG. 3 when the device 6 is tilted into the dotted line position of FIG. 1. The rod 52 and the weight 62, which function as a pendulum, remain vertical with the disc 42, therefore, remaining horizontal since it is attached to the rod 52. It is the casing 12 that assumes an angular relation by reason of the deflective force caused by the aggregate 116.**

At any rate, it should be readily apparent that the rocking of the disc 42 will cause the upper end 55 of the rod 52 to move upwardly against the lower end of the plunger 78, the upper end 55 of the rod 52 thus functioning as the engaging means for the plunger, with the consequence that the plunger 78 is forced upwardly to cause the resilient contact arm 80 to separate the contact 82 from the contact 84 and at the same time move the contact 92 into engagement with the contact 94.

It is important to understand that the point on the flange 44 about which the disc 42 pivots is offset from the center thereof where the upper end 55 of the rod 52 is located. In this regard, it will be obvious from FIGS. 2 and 3 that the peripheral flange or skirt 44 is therefore radially offset from the rod portion 54. In other words, the pivot point is not on the vertical axis of the rod 52. This requires more of a tilting angle to occur than where the pivot point is near the vertical axis, which is a very disirable and worthwhile feature of the invention. Consequently, there is what can be best described as a moment arm existing between the rod end 55 and the peripheral flange or skirt 44.

Not only is the above so, but there is a certain mass that must be raised during the rocking action, for the rod 52 and its weight member 62 must be lifted in the process of actuating the plunger 78 upwardly. This creates what is termed a dead-ban d angle because a certain amount of tilting can occur without the disc 42 being rocked. It is believed evident from FIG. 3 that a tilt will result in both the segmental portions **44*c*, 44*d* remaining in contact with the platform 34 through a predetermined swing angle of the rod 52 determined by the diameter of the flange or skirt 44.** If the diameter is comparatively small, then the moment arm will be relatively small and the tilting action will occur more readily than where the diameter is greater and the resulting moment arm greater. There is always, however, a self-centering return once the deflective or tilt force is removed.

One of the distinct advantages derived from the dead angle feature just alluded to is that small tilting angles are ignored in practicing my invention, whereas when utilizing mercury switches the response is to relatively small angles because the mercury pool is shifted far more readily than the disc 42 can be rocked in the present instance. The dead angle also improves the vibration characteristics of the device 6, making it less vulnerable to faulty operation than where mercury switches are employed.

Where the tilt should not be immediate, then it is highly desirable to utilize the damping fluid 64 which resists a quick shift of the weight member 62, the rate of retardation depending upon the viscosity of the selected fluid 64. The fluid 64 likewise affects the rate of return, which can also be important in some installations. Inasmuch as it is planned that a fluid 64 will be employed in most instances, the use of the flexible bellows 66, along with the O-ring 40, assures that the lower portion of compartment of the casing 12 will be sealed from the upper portion containing the disc 42 and that no fluid can pass therebetween.

While the bellows 66 prevents any transfer of the fluid 64, it will be observed that the downwardly extending skirt or flange 44 provides a concave configuration as far as the disc 42 is concerned. The use of a flat disc, at least a disc having a flat lower surface, could cause a sticky condition to develop by reason of two flat surfaces (the upper surface of the platform 34 being the second such flat surface) confronting each other. In other words, the surface tension, particularly if there is a film of oil existing, could adversely influence or affect the operation. However, the rounded knife edge shape imparted to the lower edge of the flange or skirt 44 obviates any possibility of a sticky condition arising which could adversely affect the operation of my device 6.

Hence, it should be obvious that the device 6 is indeed quite versatile and can be employed in a number of situations without modification. Where modification to meet certain criteria is needed, the user has the option of changing the disc 42 and/or the weight member 62 in order to increase or decrease the dead-band angle. Also, he has the choice of using the fluid 64 or not, and if used, he can select a fluid having the most appropriate viscosity for the particular conditions to be encountered. Additionally, cognizance should be taken of the fact that whereas segmental portions 44*a*, 44*b*, 44*c* and 44*d* have been specifically labeled, these labeled portions need not serve as the only fulcrum or pivot points. Any segment or point on the edge of the flange or skirt 44 can function as the fulcrum or pivot point, the device 6 being responsive to a tilt in any direction from the vertical.

I claim:

1. A tilt switch device comprising an elongated casing, a circular disc provided with a downwardly directed flange having a semicircular peripheral knife edge, said disc having a centrally threaded vertical passage extending completely therethrough, a rod having its upper end portion threadedly received in said passage to permit vertical adjustment of said rod with respect to said disc, said rod extending downwardly from said disc, a weight member carried by said rod adjacent its lower end, a platform fixedly located in the upper portion of said casing for supporting the peripheral knife edge of said disc, said platform having a hole through which said rod depends downwardly, a switch unit having an operating member disposed generally above the center of said disc, the upper end of said rod being engageable with said operating member so that when said disc is rocked relative to said platform said operating member is actuated by said rod end to operate said switch unit, and a damping fluid contained in the lower portion of said casing to retard relative movement of said weight member.

2. A tilt switch in accordance with claim 1 including a flexible bellows having a first portion adhered to the underside of said platform circumjacent said hole and having a second portion adhered to said rod, whereby passage of fluid is prevented from said lower portion of said casing through said hole into the section of said casing containing said disc and switch unit.

* * * * *